US005159139A

United States Patent [19]

Beals et al.

[11] Patent Number: 5,159,139

[45] Date of Patent: Oct. 27, 1992

[54] DRUMHEAD WITH OVERTONE SUPPRESSION

[75] Inventors: Robert C. Beals, Dodge City, Kans.; Robert A. Gatzen, Newington, Conn.

[73] Assignee: Evans Products, Inc., Dodge City, Kans.

[21] Appl. No.: 537,037

[22] Filed: Jun. 13, 1990

[51] Int. Cl.[5] ..... G10D 13/02

[52] U.S. Cl. ..... 84/414

[58] Field of Search ..... 84/308, 411 R, 411 A, 84/412–417, 419, 420; D17/22

[56] References Cited

U.S. PATENT DOCUMENTS

| | | | |
|---|---|---|---|
| 4,325,281 | 4/1982 | Hardy | 84/411 M |
| 4,742,753 | 5/1988 | Speed | 84/414 |
| 4,779,508 | 10/1988 | Beals | 84/414 |

FOREIGN PATENT DOCUMENTS 1109736 6/1961 Fed. Rep. of Germany .

*Primary Examiner*—L. T. Hix
*Assistant Examiner*—Howard B. Blankenship
*Attorney, Agent, or Firm*—Kokjer, Kircher, Bowman & Johnson

[57] ABSTRACT

A drumhead having a tone control ring which suppresses unwanted overtones while preserving the desirable fundamental tones. The tone control ring has its outside edge fixed to the drumhead hoop and extends along the inwardly facing surface of the drumhead sheet with its inside edge free to move and located inwardly of the bearing area of the drumhead. Small vent openings may be provided in the peripheral area or some other vibrational area of the drumhead to accelerate the decay of vibrations for further muffling of overtones. In an embodiment of the invention applicable to bass drums, the batterhead of the base drum is provided with an imperforate annular flap interposed loosely between the control ring and the drumhead for additional overtone suppression.

26 Claims, 3 Drawing Sheets

DRUMHEAD WITH OVERTONE SUPPRESSION

BACKGROUND OF THE INVENTION

This invention relates generally to the field of musical drums and deals more particularly with a drumhead which is specially constructed to suppress and muffle unwanted overtones and vibrations without detracting from the characteristics of desirable fundamental tones.

In the music industry, drummers and sound engineers have recognized that the peripheral areas of the drumhead produce unwanted ringing and overtones that detract from the sound of the primary fundamental tones. Various approaches have been taken to attempt to suppress the unwanted overtones. For example, tape and other laminations have been applied to the playing surface of the drumhead. Although this technique has been somewhat successful, it has been less than satisfactory in a number of respects. Perhaps most notably, the laminated material is relatively thick and thus muffles desirable sounds as well as unwanted overtones. The thickness of the lamination also alters the feel of the drum and can detract from the clarity and crispness of the initial drum sound when the head is struck by the drumstick.

Bass drums have been particularly difficult to muffle adequately. Blankets and pillows of various types are commonly installed inside of the drum shell by individual drummers to serve as mufflers which are intended to decrease the overtones and rattles on the front head that result from striking of the batter head. Aside from the manifest problems caused by this technique, it does not effectively muffle the undesirable acoustical effects and is not uniform in its performance from one situation to another.

With the advent of digital recording and playback and with the increasingly high quality demands that have been placed on musical recordings and performances in recent years, the foregoing problems have been increasingly serious detriments to achieving acceptable drum performance. Consequently, there is a clear need to provide a way to decrease these problems and thereby improve the acoustical properties of drums.

SUMMARY OF THE INVENTION

The present invention is directed to a uniquely constructed drumhead which exhibits improved acoustical characteristics both for snare drums and bass drums. In accordance with the invention, the edges of the drumhead are muffled by a special internal tone control ring which suppresses ringing and overtones while preserving the desirable "attack" characteristics of the drum (the clarity and crispness of the fundamental tones when the drumhead is struck). It is important to the effective performance of the tone control ring that its outer edge is fixed to the drumhead hoop and its inner edge is free to move against the inside surface of the drumhead to resist the drumhead vibration.

Another aspect of the present invention involves providing the drumhead with small vent holes which allow air to escape diminishing the head ability to vibrate and thus accelerating the decay of the drumhead vibrations in order to reduce unwanted overtones, again without diminishing the attack characteristics of the drum. The vent holes may be provided on a drumhead that is devoid of a tone control ring, they may be aligned holes that extend through both the drumhead and the tone control ring, or, in the case of a bass drum front drumhead, they may be "miking" holes located inwardly of the tone control ring and serving to transmit the sound of the drum to a microphone either for live performances or recording sessions.

The invention is also directed to an improved batter head for a bass drum. In addition to the tone control ring and aligned holes through the ring and drumhead, an imperforate annular flap is interposed between the ring and the drumhead to provide additional suppression of overtones and enhancing the feel of the head to the player. The result is that acoustical balance between the attack and decay components of the drum sound is achieved and a clear attack sound is produced.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
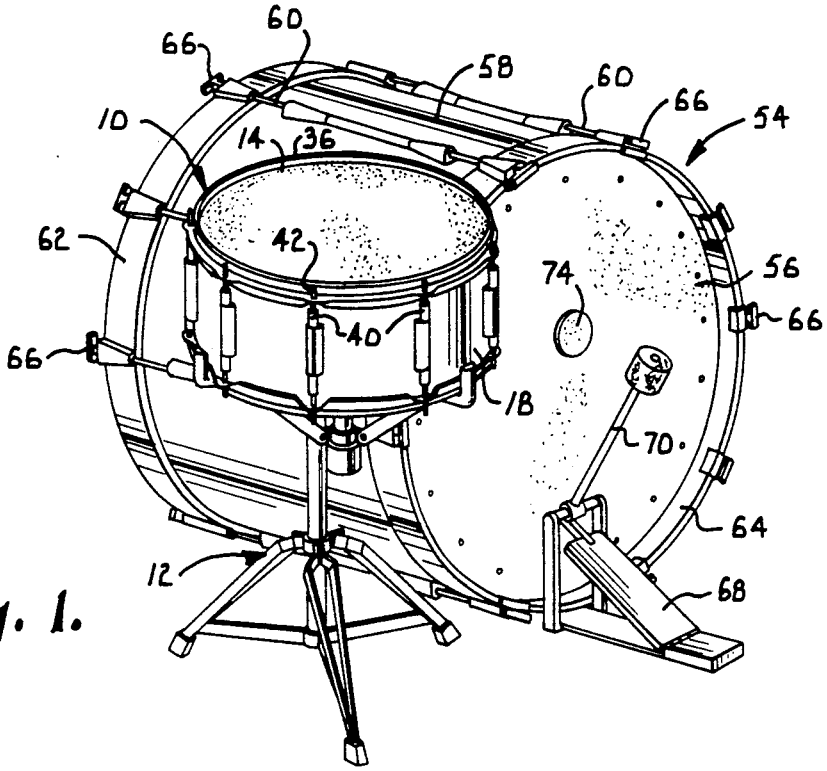
FIG. 1 is a perspective view of a bass drum and a snare drum which are equipped with drumheads constructed according to the present invention.
Figure 2:
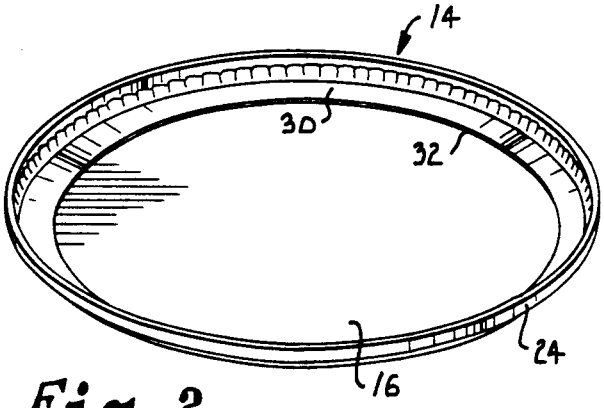
FIG. 2 is a perspective view of the inside portion of a drumhead constructed according to one embodiment of the invention.
Figure 3:
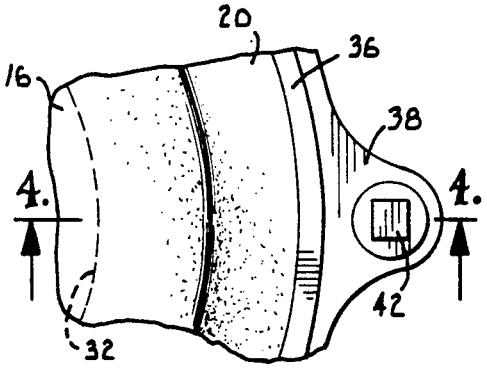
FIG. 3 is a fragmentary top plan view on an enlarged scale of the drumhead shown in FIG. 2 installed on a snare drum shell.
Figure 4:
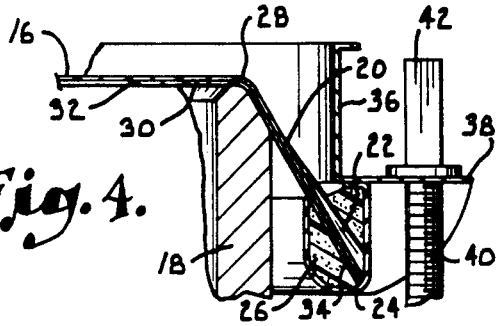
FIG. 4 is a fragmentary sectional view taken generally along line 4—4 of FIG. 3 in the direction of the arrows.

Referring now to the drawings in more detail and initially to FIG. 1, numeral 10 generally designates a snare drum which is mounted on a stand 12. The snare drum 10 is constructed conventionally for the most part but is equipped on its top end with a drumhead 14 constructed in accordance with the present invention. With reference additionally to FIGS. 2–4, the drumhead 14 includes a thin polyester film 16 forming a drumhead sheet having a planar circular surface that forms the playing surface of the drum. The film 16 is stretched across the upper end of a cylindrical drum shell 18. A flange 20 is formed on the periphery of the film 16 outwardly of the shell and extends downwardly and outwardly from the central planar portion of the film 16. The flange 20 is provided with flutes 22 which accommodate the change of direction of the plastic film where its flange is bent away from the planar central portion of the film.

The flange 20 is secured to a metal hoop 24 which is generally U-shaped in section. The free edge of the flange 20 is embedded in a quantity of bonding material which preferably takes the form of polyester resin 26 which substantially fills the U-shaped hoop 24. The hoop 24 is thus bonded to the edge of the film 16. A bearing area 28 is formed on the film 16 at the junction between the planar portion of the film 16 and the angled flange 20. When the drumhead 14 is installed on the shell 18, the bearing area 28 bears against the upper edge of the shell 18.

In accordance with one embodiment of the present invention, the drumhead 14 is provided with a tone control ring which is generally identified by numeral 30 and which functions to suppress unwanted overtones and ringing sounds. The ring 30 is formed from a thin film material which is preferably polyester having a relatively rough mat finish. The thickness of the film which forms ring 30 can vary over a considerable range and still exhibit good performance characteristics As shown particularly in FIGS. 2 and 4, the tone control ring 30 is an annular member having an inside edge 32 and an outside edge 34. The outside edge portion 34 of ring 30 is embedded in the resin 26, thus fixing the ring 30 as a permanent part of the drumhead 14. The ring is located adjacent to the inwardly facing or inside surface of the drumhead film 16. The width of the ring 30 is such that its inside edge 32 is located well inwardly of the bearing area 28 of the drumhead. Part of the tone control ring 30 thus immediately underlies the periphery of the planar portion of the film 16. The edge 32 and the adjacent portion of ring 30 are free to move freely against the drumhead film 16.

The snare drum 10 includes a counterhoop 36 which bears against the top of the hoop 24. Spaced apart lugs 38 project outwardly from the counter hoop 36, and tension rods 40 extend between the lugs 38 on opposite ends of the drum in order to adjust the tension of the drumhead in a conventional manner. The tension is adjusted by tension nuts 42 that are applied to the tension rods 40.

Figure 5:
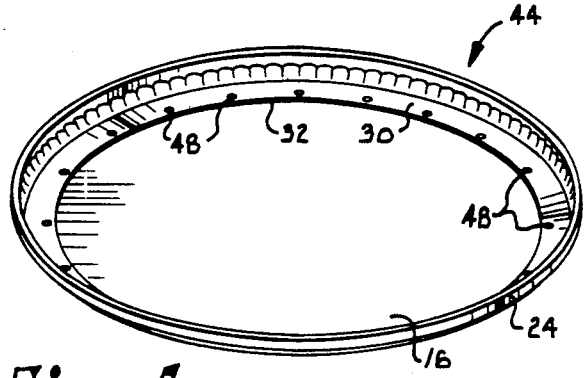
FIG. 5 is a perspective view from the inside of a drumhead constructed according to another embodiment of the invention.

When the snare drum is used, the tone control ring 30 muffles the peripheral areas of the drumhead and thus acts to suppress the ringing and overtones that would otherwise result from playing of the drum. It is important to recognize that the inner edge portion 32 of the tone control ring 30 is a free edge, and this edge portion of the ring can thus move freely against the inside surface of the drumhead in order to resist the vibration of the head. As a consequence, the unwanted overtones are suppressed while the dominant or fundamental tones are essentially unaffected so that the attack characteristics of the drum remain clear and crisp. These results are achieved by fixing the outer end 34 of the ring in order to locate the ring against the inside surface of the film 16 while at the same time leaving the inner edge 32 free such that part of the tone control ring can move freely against the inside surface of the drumhead In FIGS. 5–7, a drumhead generally identified by numeral 44 represents an alternative embodiment of the invention. The drumhead 44 is constructed for the most part in the same manner as the drumhead 14, except that the film 16 is provided with a plurality of small vent openings 46 which are aligned with similar vent openings 48 formed through the tone control ring 30. The openings 46 and 48 are circular and have the same diameter. It has been found that the diameter of the vent openings should be less than about ¼ inch in order to exhibit satisfactory performance without unduly weakening the drumhead. The aligned openings 46 and 48 are located near the periphery of the drumhead and lie on a circle which is concentric with the circular planar part of the film 16 and thus centered on the drumhead The vent openings are located outwardly far enough so that they are beyond the area of the drumhead normally struck when the drum is played. Although the number of openings may vary, there are twenty of the openings 46 and twenty of the openings 48 in the illustrated embodiment.

Figure 6:
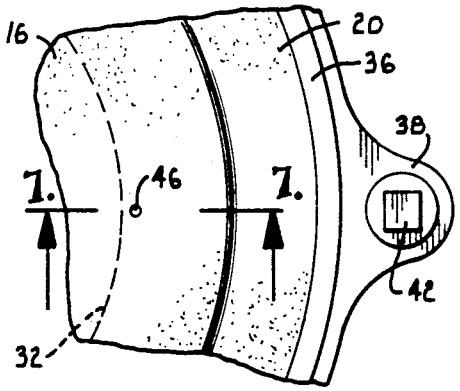
FIG. 6 is a fragmentary plan view on an enlarged scale showing the drumhead of FIG. 5 installed on a snare drum shell.
Figure 7:
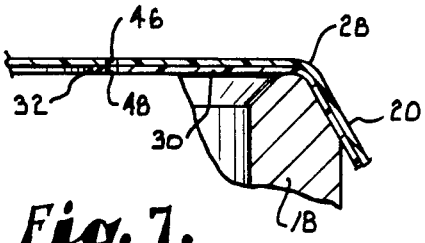
FIG. 7 is a fragmentary perspective view taken generally along line 7—7 of FIG. 6 in the direction of the arrows.

When the drumhead 44 is struck in use, the tone control ring 30 functions in substantially the same manner described previously in connection with the embodiment of the invention shown in FIGS. 1–4. In addition, the aligned openings 46 and 48 serve as vents which allow air to escape from the drum. This diminishes the vibration of the drumhead and accelerates the decay of the vibration that is imparted when the head is struck. Consequently, the unwanted secondary vibrations are suppressed while the fundamental tones are virtually unaffected so that the attack characteristics of the drum are preserved. The tone control ring 30 and the aligned openings 46 and 48 act in cooperation with one another to provide the drum with a good feel, a more focused sound, and excellent stick response As illustrated in FIG. 6, the vent openings are located such that one of them is aligned with each tension rod on a radial line that extends to the center of the drumhead through the tension rod and the aligned vent opening. This places the vent openings where they are best able to beneficially affect the drumhead vibration.

Figure 8:
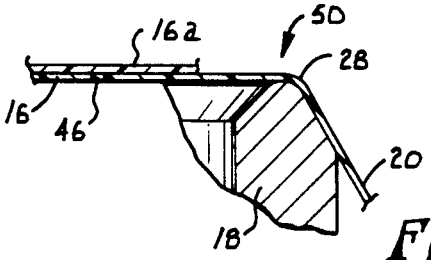
FIG. 8 is a fragmentary sectional view similar to FIG. 7, but showing a modified drumhead that is not provided with a tone control ring but which is provided with vent openings.

Referring now to FIG. 8, another embodiment of the invention provides a drumhead 50 which differs from the drumhead 44 only in that the tone control ring 30 is not present. The vent openings 46 through the film 16 act in substantially the same manner as the aligned openings 46 and 48 described previously, and the vent openings 46 thus enhance the performance of the drumhead 50. It should be noted that the vent openings 46 may be formed through a drumhead having a single ply head through either or both films of a double ply drumhead having two plies 16 and **16*a* (as shown in FIG. 8**), or through one or more plies of any multiple ply drumhead. Again, one opening is preferably aligned with each tension rod on a radial line.

Figure 9:
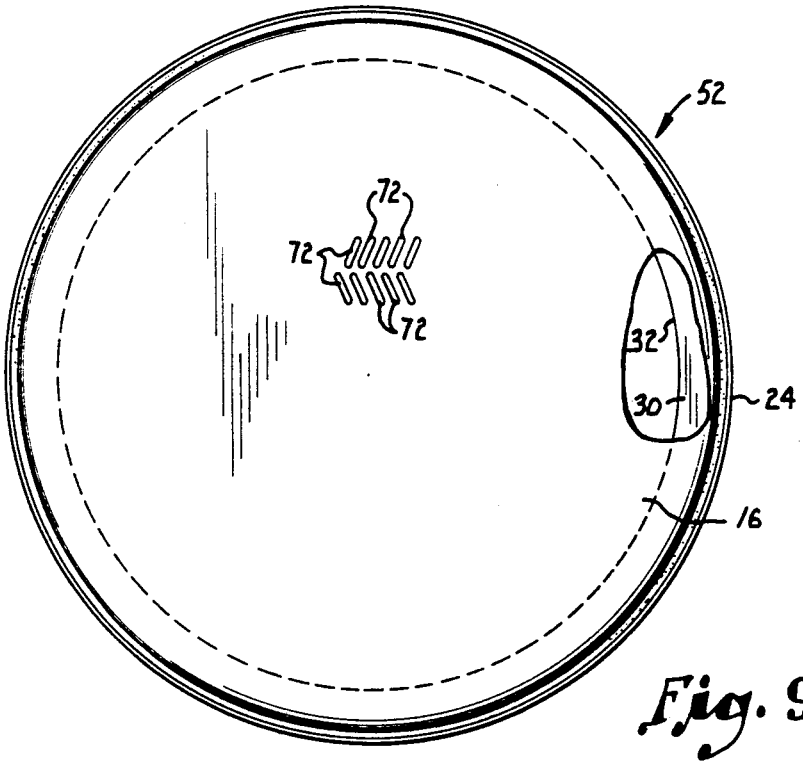
FIG. 9 is an end elevational view of a bass drum front drumhead constructed in accordance with the present invention, with a portion broken away for purposes of illustration.

FIG. 9 depicts a front drumhead 52 for a bass drum such as the drum generally identified by numeral 54 in FIG. 1. The bass drum 54 is constructed conventionally for the most part but is equipped on one end with a batter head 56 constructed in accordance with the present invention and on the other end with the front head 52 shown in FIG. 9. The bass drum 54 includes a cylindrical shell 58 and tension rods 60 which act against counterhoops 62 and 64 to adjust the tension of the front head 52 and the batter head 56. Tee handles 66 are provided for adjustment of the tension rods 60. The bass drum 54 is also equipped with a pedal 68 that can be depressed with the foot in order to drive a beater 70 against the batter head 56.

Referring again to FIG. 9, the front head 52 is constructed in a manner similar to the snare heads described previously, except that the bass drumhead is considerably larger. For example, a snare drum is typically between 12 inches and 17 inches in diameter whereas a bass drum is typically between 18 inches and 28 inches in diameter.

The front head 52 includes the film 16 which forms the drumhead sheet and also with the tone control ring 30. In addition, a plurality of vent openings 72 are provided through the film 16. It is noted that the openings 72 take the form of elongated slits that serve as "miking" vents. A microphone is normally positioned adjacent to the vents 72 in order to pick up the primary attack sound that results when the opposite batter head 56 is struck with the beater 70. In addition, the microphone is able to pick up the vibration of the front head.

The vents 72 additionally vent the air and thus suppress undesired overtones in the same manner described previously in connection with the vent openings 46 and 48. The batter head 56 is provided with a patch 74 (see FIGS. 1 and 10) at the batter area which is the area that is struck by the head of the beater 70. The vents 72 are located adjacent to one another in an area that is aligned with the patch 74 longitudinally of the shell 58. Consequently, the sound resulting from striking of the patch 74 is transmitted directly through the drum shell to the area of the vents 72 and through the vents to the microphone. Although it is preferred that the vents 72 be elongated slits, they can also be circular holes and can assume other shapes as well without detracting significantly from their performance.

As an alternative to the front drumhead 52 shown in FIG. 9, the front head of the bass drum can be constructed in the manner shown for the drumhead 44 illustrated in FIGS. 4–7, except that it should be larger in order to accommodate the larger bass drum. In this case, the aligned openings 46 and 48 serve as vents in the manner described previously and also to transmit the sound to a microphone that may be used either for a recording or for live performances.

Figure 10:
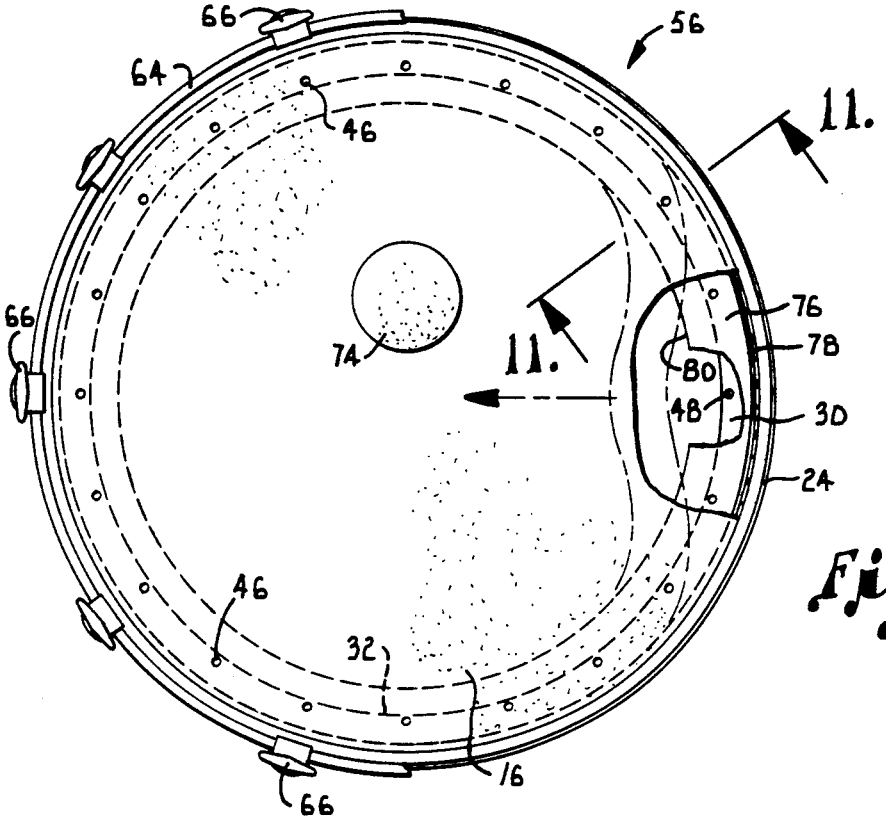
FIG. 10 is an end elevational view of the bass drum shown in FIG. 1 equipped with a batter head constructed in accordance with the present invention, with portions broken away for purposes of illustration.
Figure 11:
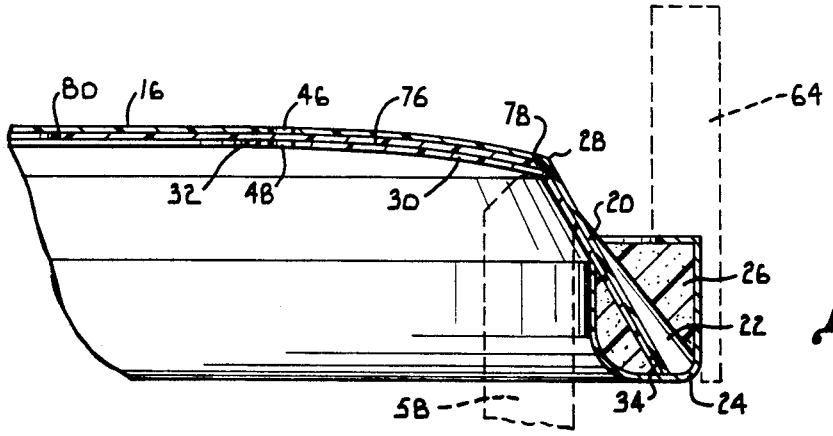
FIG. 11 is a fragmentary sectional view on an enlarged scale taken generally along line 11—11 of FIG. 10 in the direction of the arrows.

The batter head 56 is shown more particularly in FIGS. 10 and 11. The batter head is the head of the bass drum that is actually struck with the beater 70, and it is constructed largely in the manner illustrated for the drumhead 44 shown in FIGS. 5–7, except that the batter head 56 is larger and is provided with an additional annular flap 76 which is interposed between the tone control ring 30 and the drumhead film 16. The annular flap 76 fits loosely between the film 16 and ring 30 and is connected to neither. The flap 76 is a substantially flat member having an outer edge 78 located adjacent to the bearing area 28. The flap 76 is somewhat wider than the tone control ring 30, and the inside edge 80 of flap 76 thus projects well inwardly from the inside edge 32 of the ring 30. The flap 76 extends between the aligned sets of openings 46 and 48 and normally closes them. However, the flap 80 can move with respect to both the film 16 and the tone control ring 30 so that small amounts of air can through the openings 46 and 48 when the drumhead is struck. The tone control ring 30 and the flap 80 both suppress undesirable overtones by moving against the inside of the film 16 in order to resist its vibration. By using both the tone control ring and the flap on the larger bass drum batter head, good acoustical balance is achieved between the attack and decay components of the drum.

Figure 12:
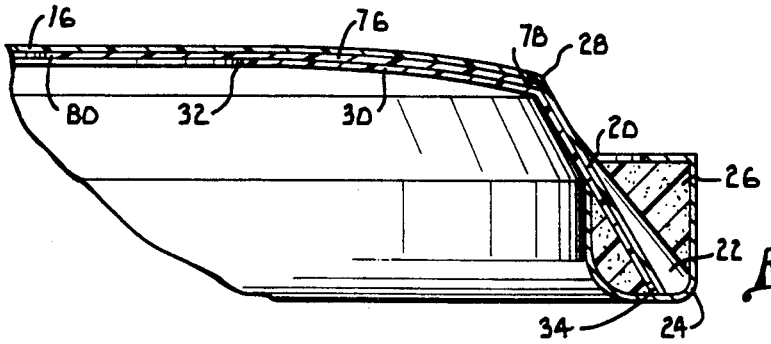
FIG. 12 is a fragmentary sectional view similar to FIG. 11 but showing a modified base drum batter head.

FIG. 12 depicts an alternative construction for the batter head of the bass drum, and it differs from the construction shown in FIG. 11 only in that the openings 46 and 48 are not present in the FIG. 12 embodiment. Again, the tone control ring 30 and the loose annular flap 80 act to suppress vibration of the drumhead and to muffle unwanted overtones and ringing.

The pattern, spacing, shape and size of the vent openings in the drumhead film or films can be varied from what has been described while still retaining the beneficial characteristics of the invention. In addition to snare and bass drums, the drumhead construction of this invention is applicable to other types of drums, including tom-toms. It is again noted that the invention is also applicable to drumheads which include multiple plies and that vent openings may be provided through one or more (or all) of the plies in order to enhance the acoustical performance of the drum.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, we claim:

1. A drumhead comprising:

a drumhead sheet having an inwardly facing surface and an outwardly facing surface and terminating in a peripheral edge portion presenting a bearing area for bearing against a drum shell;

a drumhead hoop secured to said peripheral edge portion of the drumhead sheet;

a tone control ring constructed of a thin film and having inside and outside edges;

means for securing said outside edge of the ring to said hoop with said ring adjacent the inwardly facing surface of said sheet and said inside edge free of the sheet at a location inwardly of said bearing area of the sheet and a plurality of openings through said sheet at locations adjacent to said ring.

2. A drumhead as set forth in claim 1, wherein said drumhead sheet comprises a plurality of different plies overlying one another, said openings extending through at least one of said plies.

3. A drumhead as set forth in claim 1, including a mat finish on said film.

4. A drumhead as set forth in claim 1, wherein said securing means comprises resin retained in said hoop, said outside edge of the tone control ring being embedded in said resin.

5. A drumhead as set forth in claim 1, including a plurality of openings extending through said tone control ring, the openings through said sheet being in alignment with the openings through said ring.

6. A drumhead as set forth in claim 5, wherein:

the drum shell includes a plurality of tension rods for adjusting the tension of the drumhead sheet; and one of said openings is substantially aligned with each of said tension rods on a line oriented radially on the sheet.

7. A drumhead as set forth in claim 5, including an annular flap constructed of thin film and interposed between said drumhead sheet and tone control ring, said flap projecting inwardly beyond said inside edge of the tone control ring.

8. A drumhead as set forth in claim 7, wherein said flap is imperforate.

9. A drumhead as set forth in claim 7, wherein said flap presents inside and outside edges which are both free of said sheet and said ring.

10. A drumhead as set forth in claim 1, including an annular flap constructed of thin film and interposed between said drumhead sheet and tone control ring, said flap projecting inwardly beyond said inside edge of the tone control ring.

11. A drumhead comprising:

a drumhead sheet having a substantially planar portion and a peripheral edge portion presenting a bearing area for bearing against a drum shell; and a plurality of vent openings extending through said planar portion of the drumhead sheet at a location inwardly of said bearing area to vent air therethrough and accelerate decay of vibration of the sheet, said openings being spaced apart substantially equidistantly and being located on a circle centered at the center of the drumhead sheet.

12. A drumhead as set forth in claim 11, wherein each vent opening is substantially circular and has a diameter less than one fourth inch.

13. A drumhead as set forth in claim 11, wherein:

the drum sheet includes a plurality of tension rods for adjusting the tension of the drumhead sheet; and one of said vent openings is substantially aligned with each of said tension rods on a line oriented radially on the sheet.

14. A drumhead as set forth in claim 11, including a tone control ring constructed of thin film, said ring being situated adjacent said peripheral edge portion of the sheet and having a free edge located inwardly from said bearing area.

15. A drumhead as set forth in claim 14, including a plurality of vent openings extending through said ring in alignment with the vent openings through said drumhead sheet.

16. A drumhead as set forth in claim 11, wherein:

said drumhead sheet includes multiple plies overlying one another; and said vent openings extend through at least one of said plies but less than all of said plies.

17. In a bass drum, a batter drumhead comprising:

a drumhead sheet having an inwardly facing surface and an outwardly facing surface and terminating in a peripheral edge portion presenting a bearing area for bearing against a drum shell;

a drumhead hoop secured to said peripheral edge portion of the drumhead sheet;

a tone control ring constructed of a thin film and having inside and outside edges, said outside edge being secured to said drumhead hoop to mount said ring adjacent the inwardly facing surface of said sheet with said inside edge being free and located inwardly of said bearing area of the sheet; and an annular flap interposed between said drumhead sheet and said tone control ring, said flap having an inside edge spaced inwardly from the inside edge of said tone control ring.

18. The drumhead of claim 17, including a plurality of openings through said tone control ring and a plurality of openings through said drumhead sheet aligned with the openings through said ring.

19. In a bass drum having a drum shell and a batter drumhead on one end of the shell, an improved front drumhead for the opposite end of the shell, comprising:

a drumhead sheet having inwardly and outwardly facing surfaces and a peripheral edge portion presenting a bearing area for bearing against said opposite end of the shell;

a drumhead hoop secured to said peripheral edge portion of the sheet;

a tone control ring constructed of a film and having inside and outside edges, said outside edge being secured to said drumhead hoop to mount said ring adjacent the inwardly facing surface of said sheet with said inside edge being free of the sheet and located inwardly of said bearing area of the sheet; and a plurality of vent openings through said drumhead sheet to vent air therethrough.

20. The front drumhead of claim 19, including a plurality of vent openings through said ring in alignment with the vent openings through said sheet.

21. The front drumhead of claim 19, wherein said vent openings are located radially inwardly from said inside edge of the tone control ring.

22. The front drumhead of claim 21, wherein said vent openings have the form of elongated slits.

23. The front drumhead of claim 21, wherein:

the batter drumhead presents a batter area which is struck when the drum is played; and said vent openings occupy a preselected area on said drumhead sheet which is aligned with said batter area longitudinally of the shell.

24. A drumhead comprising:

a drumhead sheet having a peripheral edge portion presenting a bearing area for bearing against a drum shell;

a plurality of tension rods for adjusting the tension of the drumhead sheet; and a plurality of vent openings extending through said drumhead sheet at a location inwardly of said bearing area to vent air therethrough and accelerate decay of vibration of the sheet, one of said openings being substantially aligned with each of said tension rods on a line oriented radially on the sheet.

25. A drumhead comprising:

a drumhead sheet having a peripheral edge portion presenting a bearing area for bearing against a drum shell, said sheet including multiple plies overlying one another; and a plurality of openings extending through at least one of said plies but less than all of said plies at a location inwardly of said bearing area to accelerate decay of vibration of the sheet.

26. In a base drum having a drum shell and a batter drumhead on one end of the shell presenting a batter area that is struck when the drum is played, an improved front drumhead for the opposite end of the shell comprising:

a drumhead sheet having a peripheral edge portion presenting a bearing area for bearing against said opposite end of the shell, said sheet presenting a substantially planar portion inwardly of said bearing area; and a plurality of miking openings through said sheet at a preselected location aligned with said batter area of the batter drumhead to transmit sound and air through the sheet when the batter area is struck.

* * * * *